US006422772B1

(12) United States Patent
Fisher, Sr. et al.

(10) Patent No.: US 6,422,772 B1
(45) Date of Patent: Jul. 23, 2002

(54) PRINTER HAVING AN INTERFERENCE-FREE RECEIVER SHEET FEED PATH AND METHOD OF ASSEMBLING THE PRINTER

(75) Inventors: Terrence L. Fisher, Sr., Rochester; Walter S. Stevens, Fairport, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/607,166

(22) Filed: Jun. 29, 2000

(51) Int. Cl.[7] ..... B65H 1/04; B41J 11/58

(52) U.S. Cl. ..... 400/629; 400/625; 271/145; 271/902

(58) Field of Search ..... 271/145, 3.03, 271/225, 264, 207, 3.08, 163, 902; 400/629, 625, 624, 634, 636, 636.2

(56) References Cited

U.S. PATENT DOCUMENTS

| | | | | |
|---|---|---|---|---|
| 4,751,519 A | | 6/1988 | Shimada et al. | 347/218 |
| 4,849,786 A | | 7/1989 | Murakami | 399/402 |
| 4,953,994 A | | 9/1990 | Shiozaki et al. | 400/120.16 |
| 5,327,206 A | | 7/1994 | Ueda et al. | 399/402 |
| 5,611,526 A | | 3/1997 | Cornell | 271/3.01 |
| 5,961,224 A | * | 10/1999 | Baitz et al. | 400/59 |

FOREIGN PATENT DOCUMENTS

| | | | |
|---|---|---|---|
| GB | 2309687 A | * | 8/1997 |
| JP | 11-35194 A | * | 2/1999 |

* cited by examiner

*Primary Examiner*—Daniel J. Colilla
(74) *Attorney, Agent, or Firm*—Walter S. Stevens

(57) ABSTRACT

A printer having an interference-free receiver sheet feed path and method of assembling the printer. The printer, which is a thermal dye printer, comprises a print head for forming an image on a movable receiver sheet belonging to a stack of receiver sheets having a front edge portion. The stack of receiver sheets reside in a receiver sheet supply tray. A roller feeds the top-most receiver sheet along a receiver sheet feed path, leading edge first, from the supply tray and to the print head for printing by means of thermal activation of a first one of a plurality of dye donor patches belonging to a dye donor ribbon. After the first dye donor patch prints, the receiver sheet returns, trailing edge first, to the supply tray before printing by the next dye donor patch. A canopy that is connected to the supply tray is biased by a biasing member to cover the front edge portion of the stack of sheets while the receiver sheet returns to the supply tray, so that the trailing edge of the receiver sheet being printed does not abut the front edge portion of the stack of receiver sheets and crumple to possibly "jam" the printer by obstructing the feed path. An actuator is coupled to the canopy for actuating the canopy to uncover the front edge portion of the stack of receiver sheets while the receiver sheet is fed from the supply tray.

11 Claims, 14 Drawing Sheets

PRINTER HAVING AN INTERFERENCE-FREE RECEIVER SHEET FEED PATH AND METHOD OF ASSEMBLING THE PRINTER

FIELD OF THE INVENTION

The present invention generally relates to printer apparatus and methods and more particularly relates to a printer having an interference-free receiver sheet feed path and method of assembling the printer.

BACKGROUND OF THE INVENTION

A resistive thermal printer typically comprises the following components: a thermal print head having an array of selectively-activated thermal elements that transfer dyes from a dye donor to a dye receiver in an imagewise fashion; a pressure interface or "nip" formed between a platen and the print head, which platen and print head sandwich the dye donor and the dye receiver extending through the nip; a first transport mechanism for transporting the dye receiver; a second transport mechanism for transporting the dye donor; and electronics for mechanical and print head control, as well as electronics for control of data path and image processing.

More specifically, the print head commonly provides a print line of individual elements that can be individually heated to thermally transfer dye from a series of sequential color patches of the dye donor to the dye receiver. The dye donor for a color dye thermal printer is normally supplied in rolls of yellow, magenta, cyan, and sometimes black color patches. The dye receiver may be in cut sheets or rolls of paper or transparency. An image is printed by selectively heating the individual elements of the print head to transfer a first dye to the dye receiver. The dye receiver is then repositioned to receive a second color of the image, and the dye donor is positioned to provide a second dye color. These steps are repeated until all colors of the image are printed on the receiver and the completed print is ejected from the printer. In this manner, such dye color thermal printers form a color print by successively printing with a dye donor onto the dye receiver. Moreover, the print head may take any one of several forms including resistive element, resistive ribbon and laser print heads.

As stated hereinabove, the receiver may be in the form of cut sheets. In this case, the cut sheets are stacked one upon the other to define a stack of cut sheets of the receiver. The stack of cut sheets of receiver reside in a receiver sheet supply tray which is received into the printer. The receiver sheets are stacked in the tray such that a "leading" or front edge of each receiver sheet is the first edge that leaves the supply tray during printing and the "trailing" or back edge of each receiver sheet is the last edge to leave the receiver tray. That is, during printing, the leading edge of the receiver sheet to be printed is fed by an appropriate feeding mechanism along a feed path to the print head, whereupon the print head prints the image on the receiver sheet according to the color of the color patch. The receiver sheet is then fed in a reverse fashion by the feeding mechanism along the feed path until the receiver sheet, including the trailing edge, substantially returns to the supply tray. This process is repeated until all dye color patches belonging to the series of sequential color patches are printed onto the receiver sheet, so that a full color image forms on the receiver sheet. The receiver sheet is controllably moved to a precise starting position with respect to the print head by means of a leading edge sensor disposed adjacent the print head for detecting the leading edge of the receiver sheet. Of course, because each receiver sheet has a front edge, the stack of receiver sheets has a front wall or front edge.

However, it has been observed that, as the receiver sheet being printed returns to the supply tray, the trailing edge of the receiver sheet may encounter and abut the front wall or edge of the stack of receiver sheets residing in the supply tray. This is undesirable because the receiver sheet being returned to the supply tray may crumple to "jam", foul, and otherwise form an obstruction in the receiver sheet feed path. This occurrence interferes with proper operation of the printer and may even cause the printer to become inoperable. In this case, the obstruction has to be removed by the operator of the printer. This, in turn, results in printer down-time and receiver wastage, thereby causing increased cost of printer operation. It is therefore desirable to prevent receiver feed path obstruction caused by the trailing edge of the returning receiver sheet abutting the stack of receiver sheets in the supply tray.

Devices for reducing risk of printer "jams" are known. A sheet tray for preventing printer jams is disclosed in U.S. Pat. No. 5,611,526 titled "Cut Sheet Tray Having A Weighted Pivoting Jam Prevention Member" issued Mar. 18, 1997, in the name of David J. Cornell and assigned to the assignee of the present invention. The Cornell patent discloses that risk of jams that occur during return of a cut sheet to a position inside of a cut sheet tray as the trailing edge of the sheet moves past the leading edge of the stack of sheets is reduced by having the returning sheet itself move a lever to a position over a jam area when the cut sheet is returning to the tray. The lever has a first position covering the edge of the other cut sheets and a second position removed from the edge of the other cut sheets, whereby to not interfere with sheets being fed from the stack of sheets. An abutment surface on the member is located along the sheet path to move the member between the first and second positions by the force of the cut sheet moving along the path.

Although the Cornell device satisfactorily reduces risk of printer jams, the Cornell device may not completely eliminate jams caused by the trailing edge of the receiver sheet abutting the front edge of the stack of receiver sheets. In this regard, the force of the cut sheet itself must move the lever in order to cover the jam area when the cut sheet returns to the tray. Also, the cut sheet must move the lever in order to uncover the jam area when the cut sheet is fed from the tray. However, weights of receiver sheets vary depending on the type and manufacturing batch of receiver used. For example, receivers having various percentages of rag content will have weights that differ from receivers having all-wood fiber content. In addition, receiver made from synthetic materials, such as in the case of transparencies, have a reduced coefficient of sliding friction, which may affect the ability of the lever to move as desired. Different weights and coefficients of sliding friction of receiver may cause the lever to move at different speeds or maybe not at all.

Thus, there remains a need to provide a printer having an interference-free receiver sheet feed path and method of assembling the printer.

SUMMARY OF THE INVENTION

An object of the present invention is to provide a printer having an interference-free receiver sheet feed path and method of assembling the printer, in order to prevent receiver sheet feed path obstruction due to the trailing edge of the returning receiver sheet abutting the stack of receiver sheets in the supply tray.

With this object in view, the present invention resides in a printer having an interference-free receiver sheet feed path, comprising a print head for forming a mark on a movable receiver sheet belonging to a stack of receiver sheets having an edge portion; a cover member disposed relative to the print head and capable of being actuated to cover the edge portion of the stack of receiver sheets; a biasing member coupled to the cover member for biasing the cover member, so that the cover member covers the front edge portion of the stack of sheets to prevent the front edge portion from interfering with movement of the receiver sheet; and an actuator coupled to the cover member for actuating said cover member, so that the cover member uncovers the front edge portion of the stack of sheets to prevent the cover member from interfering with movement of the receiver sheet.

According to an exemplary embodiment of the present invention, the printer includes a print head for printing an image on a receiver sheet having a trailing edge. The receiver sheet belongs to a stack of receiver sheets that reside in a receiver sheet supply tray. A roller engages the receiver sheet for advancing the receiver sheet from the stack of receiver sheets along a receiver sheet feed path extending from the stack of receiver sheets to the print head. The roller also returns the receiver sheet, trailing edge first, to the stack of receiver sheets along the same feed path. A lever, coupled to the supply tray by means of a spring, is also provided. The lever has a cover portion or canopy adapted to cover the front edge of the stack of receiver sheets when acted upon by the spring, so that the trailing edge of the receiver sheet avoids contact with the front edge of the stack of receiver sheets while the receiver sheet returns to the stack of receiver sheets in the supply tray. This, in turn, avoids crumpling of the receiver sheet in the receiver sheet feed path. In this manner, the receiver sheet feed path is interference-free because the trailing edge of the receiver sheet avoids contact with the front edge of the stack of receiver sheets. Moreover, an actuator engages the lever for providing positive actuation of the lever on demand, so that the cover portion of the lever uncovers the front edge of the stack of receiver sheets only while the receiver sheet is fed from the supply tray. The actuator is energized either by movement of the thermal print head, operation of the roller or signal generated by a leading edge sensor. Thus, the cover portion of the lever covers and uncovers the front edge of the stack of receiver sheets independent of weight and coefficient of sliding friction of the receiver sheet.

A feature of the present invention is the provision of a spring-biased lever having a cover portion for covering the front edge of the stack of receiver sheets.

Another feature of the present invention is the provision of an actuator coupled to the lever for actuating the lever in order to uncover the front edge of the stack of receiver sheets.

An advantage of the present invention is that use thereof reduces printer down-time, receiver wastage and thereby reduces cost of printer operation.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
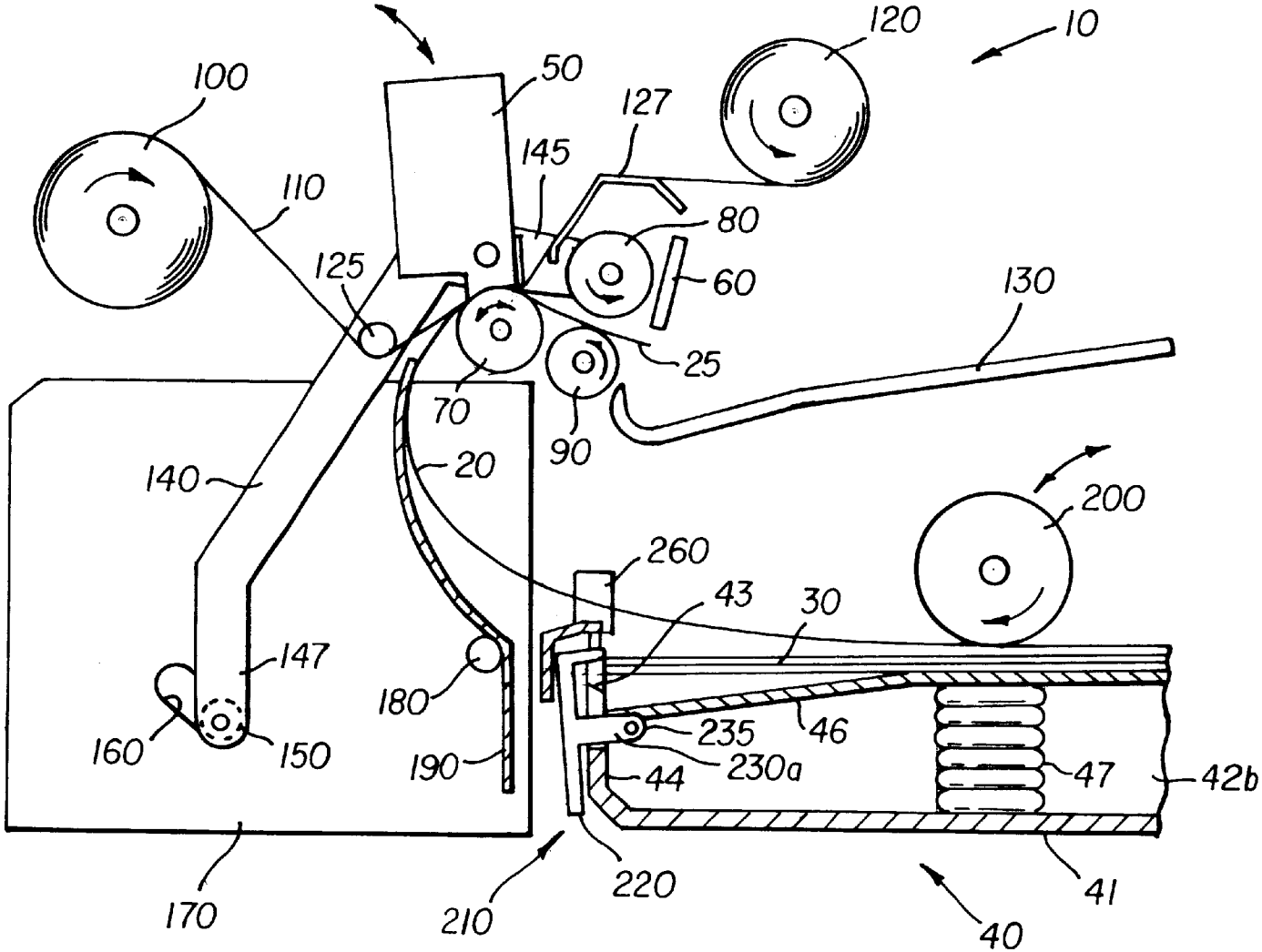
FIG. 1 is a view in elevation of a first embodiment of the present invention, with parts removed for clarity.
Figure 2:
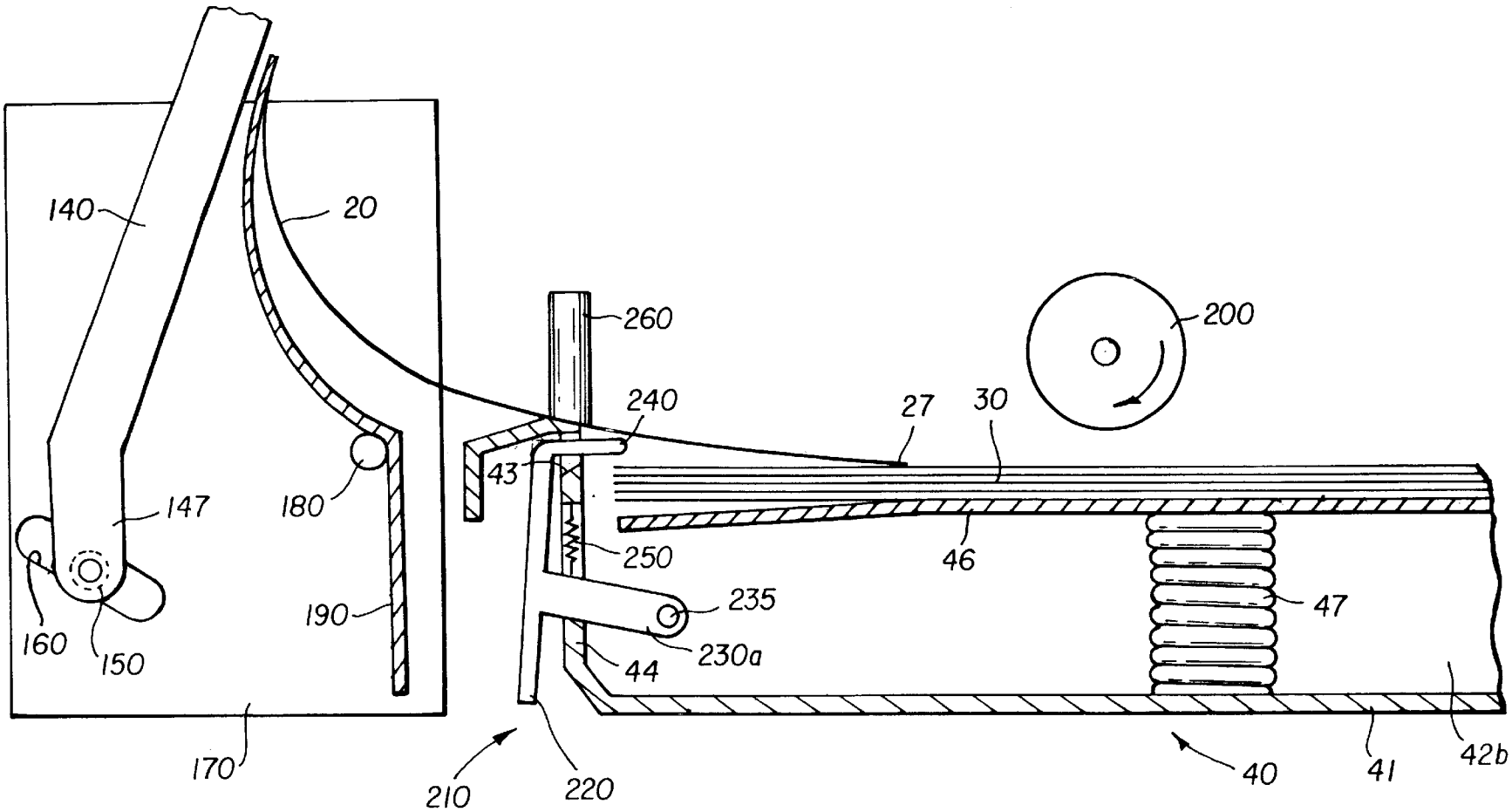
FIG. 2 is a view in elevation of a receiver supply tray including a lever shown covering a front edge portion of a stack of receiver sheets residing in the supply tray.
Figure 3:
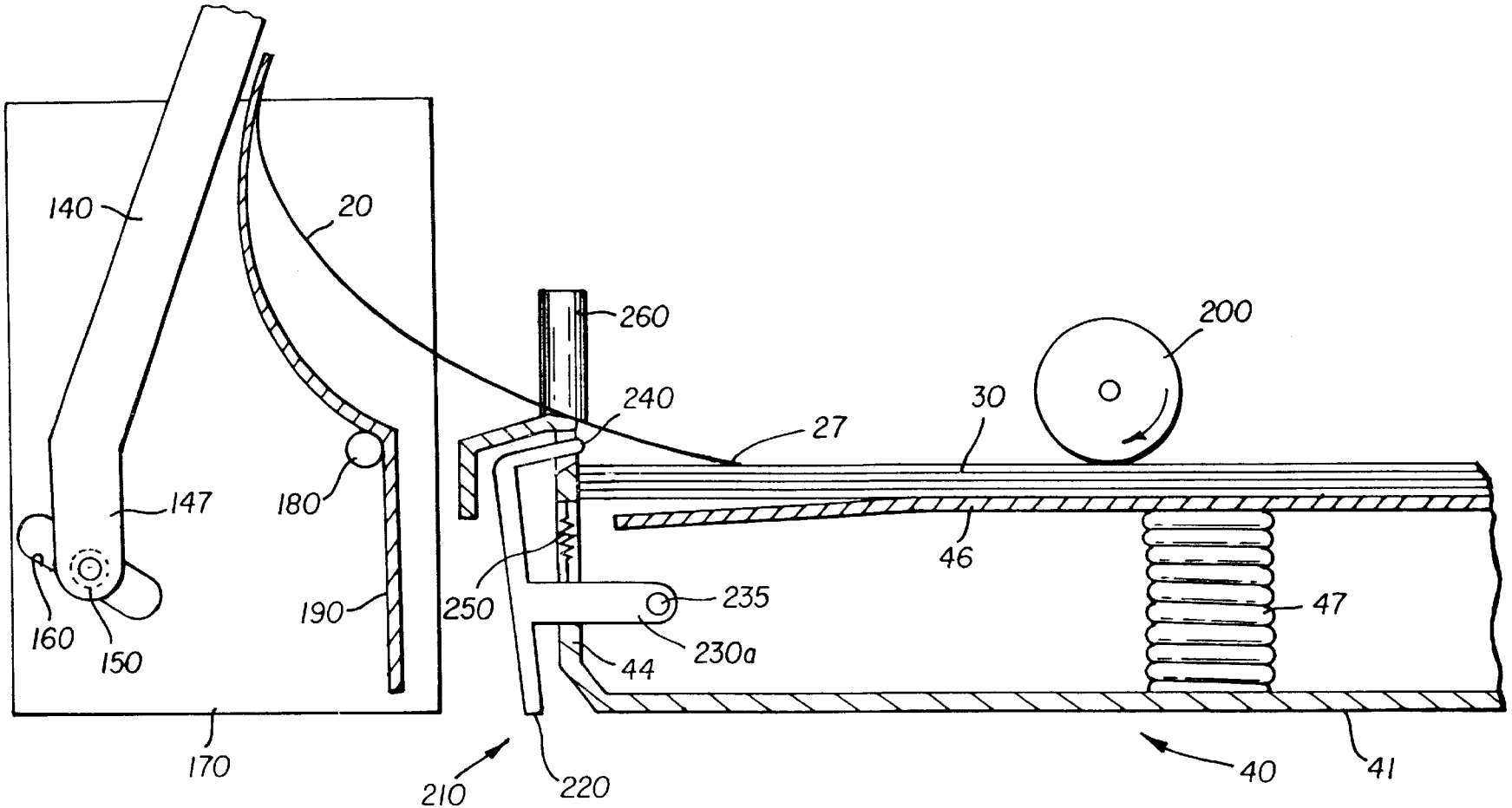
FIG. 3 is a view in elevation of the receiver supply tray including the lever shown uncovering the front edge portion of the stack of receiver sheets residing in the supply tray.
Figure 5:
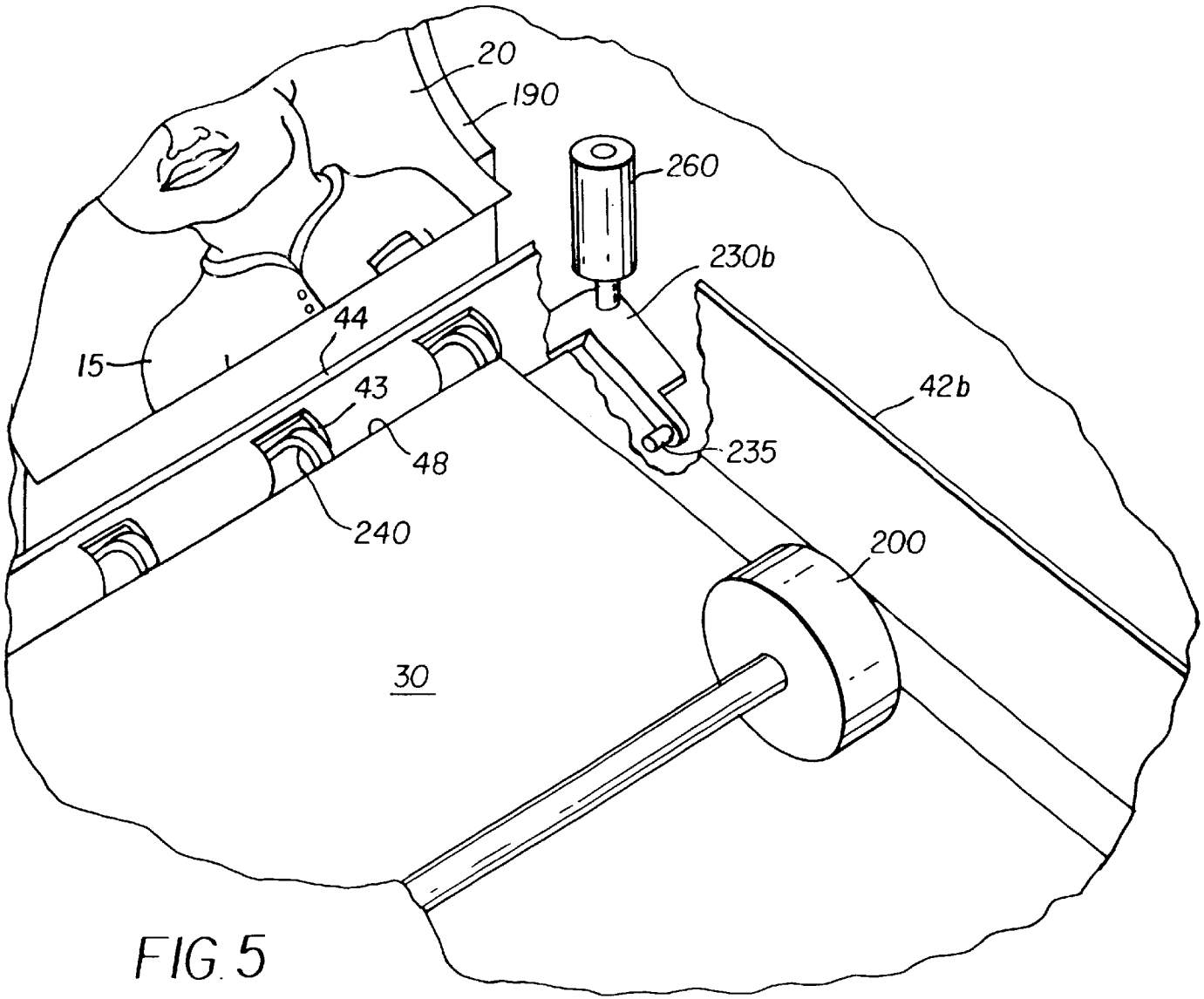
FIG. 5 is a fragmentation view in perspective of the supply tray showing the lever moving to cover the front edge portion of the stack of receiver sheets.
Figure 6:
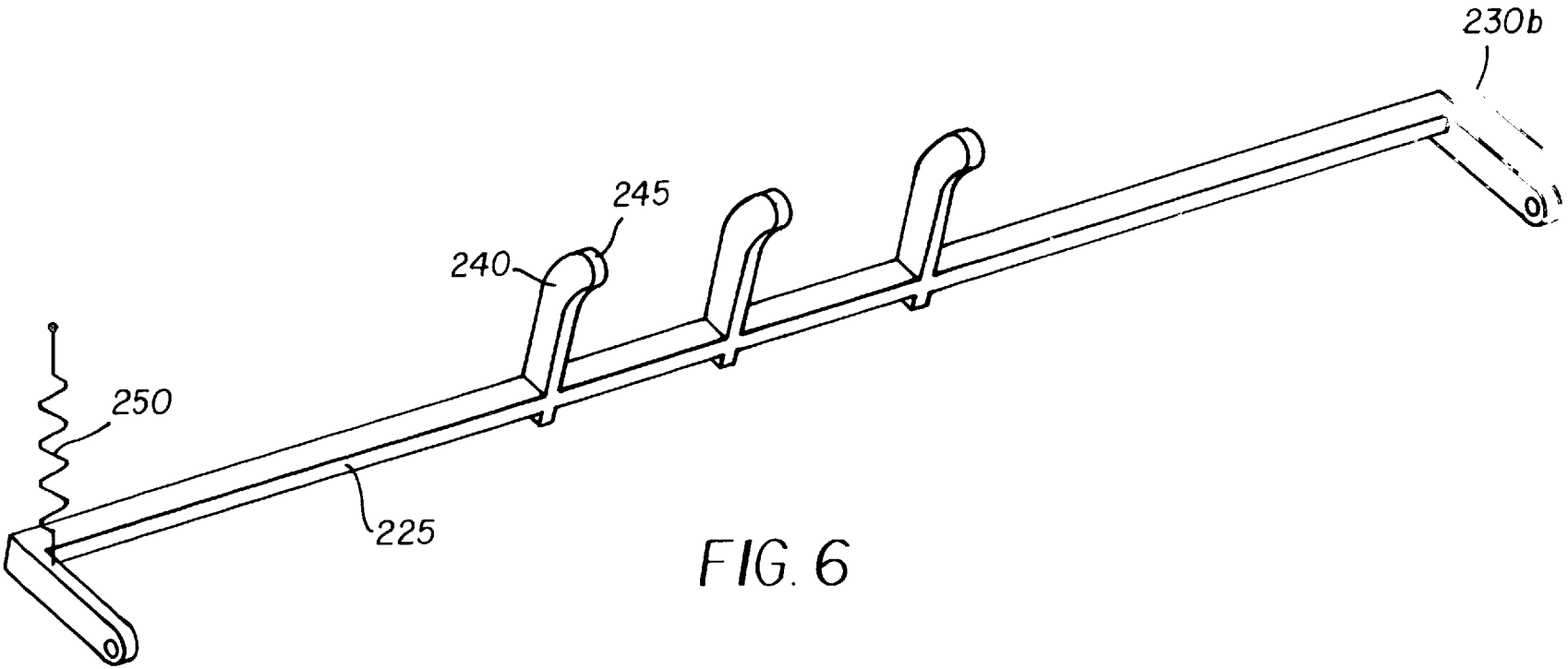
FIG. 6 is a view in perspective of the lever and a spring connected thereto for moving the lever to cover the front edge portion of the stack of receiver sheets.

Therefore, referring to FIGS. 1 and 2, there is shown a thermal resistive printer, generally referred to as 10, for forming an image 15 (see FIG. 5) on a receiver sheet 20, which may be paper, transparency or other material suitable for printing. Although the inventive concept disclosed herein is with reference to a thermal resistive printer, it is contemplated that the inventive concept obtains application in other types of printers as well, such as continuous and drop-on-demand inkjet printers. As shown in FIGS. 1 and 2, receiver sheet 20 has a leading edge 25 and a trailing edge 27 and belongs to a stack of cut receiver sheets 30 residing in a receiver sheet supply tray, generally referred to as 40. Stack of receiver sheets 30 has a front edge portion 45 (see FIG.

4). As shown in FIGS. 1 and 2, supply tray 40 comprises a tray body 41 sized to hold stack of receiver sheets 30. Tray body 41 includes oppositely disposed sidewalls 42*a* and 42*b* and has a plurality of apertures 43 formed in a front wall portion 44 thereof, for reasons provided hereinbelow. Disposed in tray body 41 is a support 46 for supporting stack of receiver sheets 30. Also, interposed between tray body 41 and support 46 is a coiled spring 47 for upwardly biasing support 46 for reasons provided hereinbelow.

As best seen in FIG. 1, printer 10 comprises a thermal resistive print head 50 formed of a plurality of resistive heating elements (not shown), for reasons disclosed hereinbelow. Although print head 50 is disclosed herein as being a thermal resistive print head having the resistive heating elements, the print head 50 may be a resistive ribbon or a laser print head, as well. Disposed near print head 50 is an optical sensor 60 for sensing leading edge 25 of receiver sheet 20. Optical sensor 60 senses leading edge 25 for reasons disclosed hereinbelow. In addition, disposed opposite print head 50 is a generally cylindrical platen 70 adapted to rotate in either a clockwise or counter-clockwise direction, as illustrated by a curved double-headed first arrow. Platen 70 is capable of engaging receiver sheet 20 for supporting receiver sheet 20 and for transporting receiver sheet 20. Disposed near platen 70 is a pinch roller 80 and a capstan traction roller 90 for providing precise movement of receiver sheet 20 between print head 50 and platen 70. For this purpose, pinch roller 80 and capstan roller 90 rotate in the directions shown.

Referring again to FIG. 1, print head 50 is capable of being upwardly and downwardly moved in an arching motion with respect to platen 70, as illustrated by a curved double-headed second arrow. In this regard, platen 70 may be connected to a reversible motor (not shown) for rotating platen 70 and print head 50 may be connected to another reversible motor (also not shown) for moving print head 50. Print head 50 and platen 70 define a collapsible nip 95 (see FIG. 7) therebetween for passage of receiver sheet 20 therethrough. Nip 95 is capable of being closed and opened when print head 50 is upwardly and downwardly moved, respectively, with respect to platen 70. As shown in FIG. 1, receiver sheet 20 is reversibly transported through nip 55 by means of engagement with rotatable platen 70. As receiver sheet 20 is advanced through nip 95, the nip 95 is closed and the previously mentioned heating elements are activated to cause printing of image 15 onto receiver sheet 20. Moreover, as receiver sheet 20 is advanced through nip 95, receiver sheet 20 will travel along a curved receiver sheet guide feed path extending from supply tray 40 to nip 95.

Referring to FIGS. 1 and 2, printer 10 further comprises a dye donor supply spool 100 adapted to rotate in a clockwise direction as illustrated by a curved single-headed third arrow. Wound about donor supply spool 60 is a movable dye-containing dye donor ribbon 110. Ribbon 110 has a plurality of sequentially arranged thermally activatable color patches (not shown) thereon. By way of example only, and not by way of limitation, the color patches may comprise the colors yellow, magenta, cyan and black.

Referring again to FIG. 1, disposed in alignment with donor supply spool 100 is a dye donor take-up spool 120 adapted to rotate in a counter-clockwise direction as illustrated by a curved single-headed fourth arrow. Donor supply spool 100 supplies dye donor ribbon 110 from donor supply spool 100 to take-up spool 120. It may be understood that as donor supply spool 100 supplies dye donor ribbon 110 to take-up spool 120, ribbon 110 will be suspended between spools 100 and 120 and pass through nip 95 defined between receiver sheet 20 and print head 50. A tensioning pin 125 and a tensioning bracket 127 for intimately engaging ribbon 110 may also be provided for tensioning ribbon 110. It may be further understood that as nip 95 closes, the previously mentioned heating elements in print head 50 are enabled such that radiative heat therefrom causes dye to transfer from ribbon 110 to receiver sheet 20 in order to form image 15 on receiver sheet 20. Ribbon 110 may be driven by take-up spool 120, which is connected to a suitable motor (not shown). In other words, as ribbon 110 is sandwiched between print head 50 and platen 40, an image is printed by selectively heating individual ones of the heating elements in print head 50 in order to transfer a first dye to receiver sheet 20. Receiver sheet 20 is then repositioned to receive a second color of the image, and ribbon 110 is advanced to provide a second dye color. These steps are repeated until all colors of image 15 are printed and the completed print is ejected into an output bin 130 for retrieval by an operator of printer 10.

Still referring to FIG. 1, movement of ribbon 110 through nip 95 and enablement of the heating elements in print head 50 are preferably synchronized to transfer the dyes from ribbon 110 to receiver sheet 20 at desired times and predetermined locations on receiver sheet 20. Therefore, a control unit (not shown) is connected to print head 50 for controlling print head 50, so that the heating elements are enabled when desired. Also, the control unit may be connected to print head 50 for upwardly and downwardly moving print head 30 in order to open and close nip 95 when required. The control unit is also connected to platen 70 for controlling rotation of platen 70, so that rotation of platen 40 is synchronized with operation of print head 50.

Referring yet again to FIG. 1, printer 10 further comprises a movable arm 140 connected to print head 50 for moving print head 50 in the previously mentioned upwardly and downwardly direction thereof. Arm 140 has a first end portion 145 to which is connected pinch roller 80 for supporting pinch roller 80. Arm 140 also has a second end portion 147. Connected to second end portion 147 of arm 140 is a freely-rotatable wheel 150 matingly slidably engaging an elongate slot 160 formed in a frame 170 for guiding arm 140 as arm 140 is moved. In this regard, arm 140 may be moved by a suitable motor (not shown). Also, affixed to frame 170 may be a support bolt 180 for supporting a guide chute 190. Guide chute 190 assists in guiding receiver sheet 20 along the previously mentioned receiver sheet guide path.

Referring again to FIG. 1, as print head 50 is downwardly moved to transfer dye to receiver sheet 20, a rotatable picker roller 200 is downwardly moved to engage receiver sheet 20 and advance receiver sheet 20 from stack of receiver sheets 30 and into the receiver sheet feed path. Of course, it may be understood that spring 47 upwardly biases support 46 so that stack of receiver sheets 30 engage picker roller 200. Picker roller 200 is adapted to rotate in a clockwise direction as shown by a curved single-headed fifth arrow, so that receiver sheet 20 advances into the feed path. Moreover, picker roller 200 is adapted to move upwardly and downwardly, such as in the direction illustrated by a double-headed sixth arrow. Of course, after a color patch belonging to ribbon 110 is printed, print head 50 and picker roller 200 upwardly move as platen roller 70 rotates in a counter-clockwise direction to return receiver sheet 20 to supply tray 40 in preparation for printing the next color patch.

Figure 4:
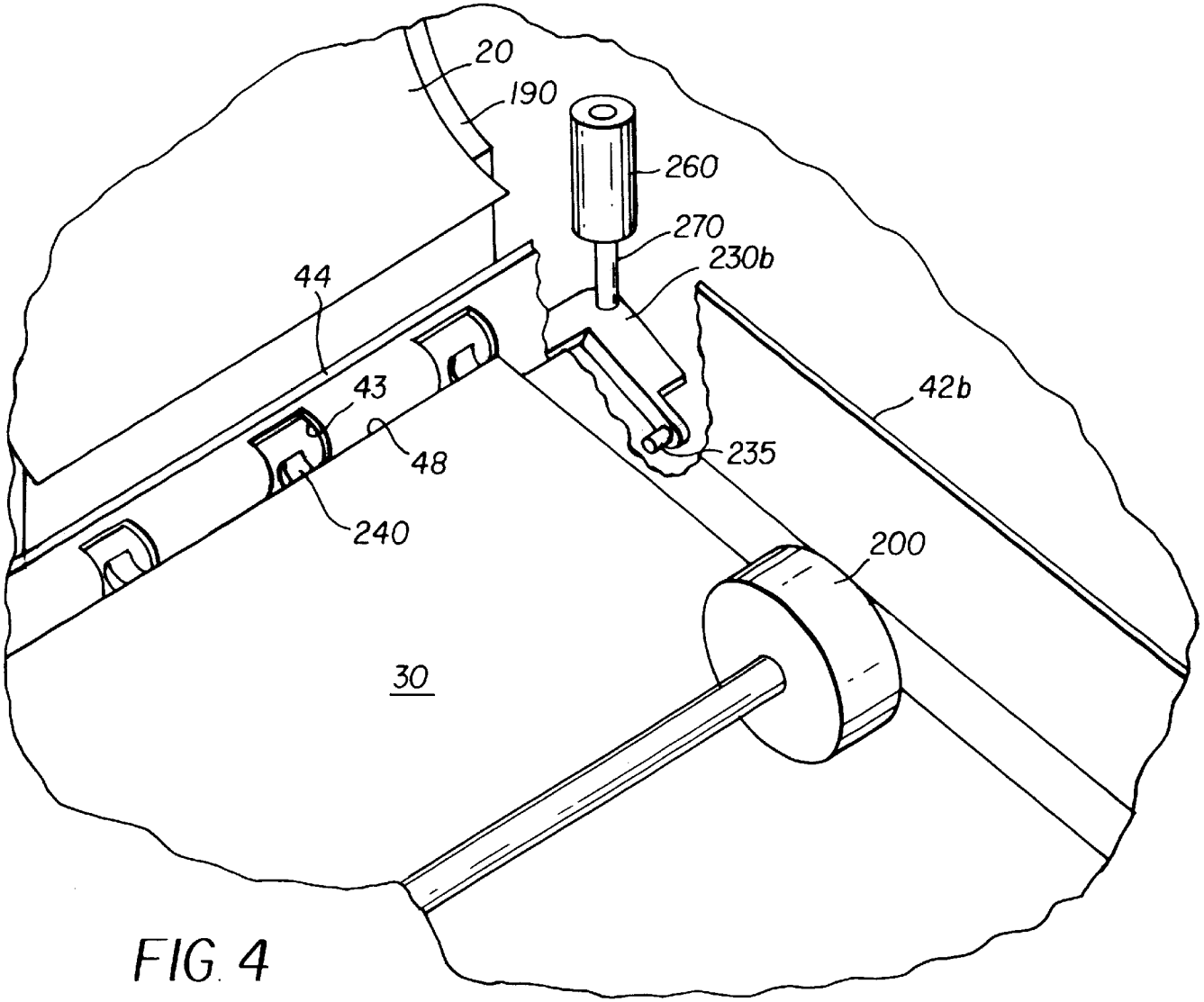
FIG. 4 is a fragmentation view in perspective of the supply tray showing a solenoid moving the lever to uncover the front edge portion of the stack of receiver sheets.

However, it has been observed that, as receiver sheet 20 returns to supply tray 40, trailing edge 27 (see FIG. 2) of receiver sheet 20 may encounter and abut front edge 48 (see FIG. 4) of stack of receiver sheets 30 residing in supply tray 40. This is undesirable because receiver sheet 20 being returned to the supply tray may crumple to "jam", foul, and otherwise obstruct the receiver sheet feed path. This occurrence interferes with proper operation of printer 10 and may even cause printer 10 to become inoperable. In this case, the printing operation has to be stopped and the obstruction removed by the operator of printer 10. This, in turn, results in printer down-time and receiver wastage, thereby causing increased cost of printer operation. It is therefore desirable to prevent receiver feed path obstruction due to trailing edge 27 of the returning receiver sheet 20 abutting front edge 48 of stack of receiver sheets 30 in supply tray 40.

Therefore, referring to FIGS. 1, 2, 3, 4, 5 and 6, movably connected to supply tray body 41 is a canopy, generally referred to as 210, capable of being spring-actuated to cover front edge portion 45 of stack of receiver sheets 30, so that trailing edge 27 will not abut front edge 48 of stack of receiver sheets 30. Canopy 210 comprises an elongate cover member or lever 220. Lever 220 in turn comprises a bar 225 (see FIG. 6) having an outwardly projecting first flange portion 230*a* integrally formed with a first end thereof and an outwardly projecting second flange portion 230*b* integrally formed with a second end thereof. First and second flange portions 230*a* and 230*b* are pivotably connected to sidewalls 42*a* and 42*b*, respectively, such as by pivot pins 235. In this manner, lever 220 is capable of pivoting in either a clockwise or counter-clockwise direction about pivot pins 235. Integrally connected to bar 225 is a cover portion in the form of a plurality of fingers 240, each sized to extend through respective ones of apertures 43 formed in front wall 44 of tray body 41. Each of fingers 240 has an end portion 245 configured to cover front edge 48 of stack of receiver sheets 30 after fingers 240 extend through apertures 43. That is, as lever 220 is caused to pivot in a clockwise direction about pivot pins 235, the lever 220 moves to a first position thereof so that bar 225 rises and fingers 240 extend through apertures 43 to cover front edge 48 of stack of sheets 30. Conversely, as lever 220 is caused to pivot in a counter-clockwise direction about pivot pins 235, the lever 220 moves to a second position thereof so that bar 225 lowers and fingers 240 retract through apertures 43 to uncover front edge 48 of stack of sheets 30.

It is important that the force of the receiver sheet 20 returning to supply tray 40 not be determinative of whether lever 220 pivots. This is important because weight of receiver sheets varies depending on the type and manufacturing batch of receiver sheets used. For example, receiver sheets having various percentages of rag content will have weights that differ from receiver sheets having all-wood fiber content. In addition, receiver made from synthetic materials, such as in the case of transparencies, have a reduced coefficient of sliding friction, which may otherwise affect the ability of lever 220 to move as desired. Different weights and coefficients of sliding friction of receiver sheets may cause lever 220 to move at different speeds or maybe not at all. Consequently, it is desirable to move lever 220 in a more positive manner, so that lever 220 pivots regardless of weight and coefficient of sliding friction of receiver sheet 20.

Referring again to FIGS. 1, 2, 3, 4, 5 and 6, printer 10 further comprises a biasing member, such as a spring 250, having a first end thereof attached to first sidewall 42*a* and a second end thereof attached to first flange portion 230*a* for positively moving lever 220, so that lever 220 pivots about pivot pins 235 in the clockwise direction as receiver sheet 20 returns to supply tray 40. In this manner, lever 220 pivots to cover front edge 48 of stack of sheets 30 regardless of weight and coefficient of sliding friction of receiver sheet 20. Printer 20 also comprises a solenoid mechanism 260 having a movable piston rod 270 contacting second flange portion 230*b* for positively moving lever 220, by means of electrical energy supplied to solenoid 250, as receiver sheet 20 is fed from supply tray 40. Thus, as solenoid 250 is energized, rod 260 depresses second flange portion 230*b* for positively biasing lever 220, so that lever 220 pivots about pivot pins 235 in the counter-clockwise direction as receiver sheet 20 leaves supply tray 40. In this manner, lever 220 pivots to uncover front edge 48 of stack of sheets 30 regardless of weight and coefficient of sliding friction of receiver sheet 20.

Figure 7:
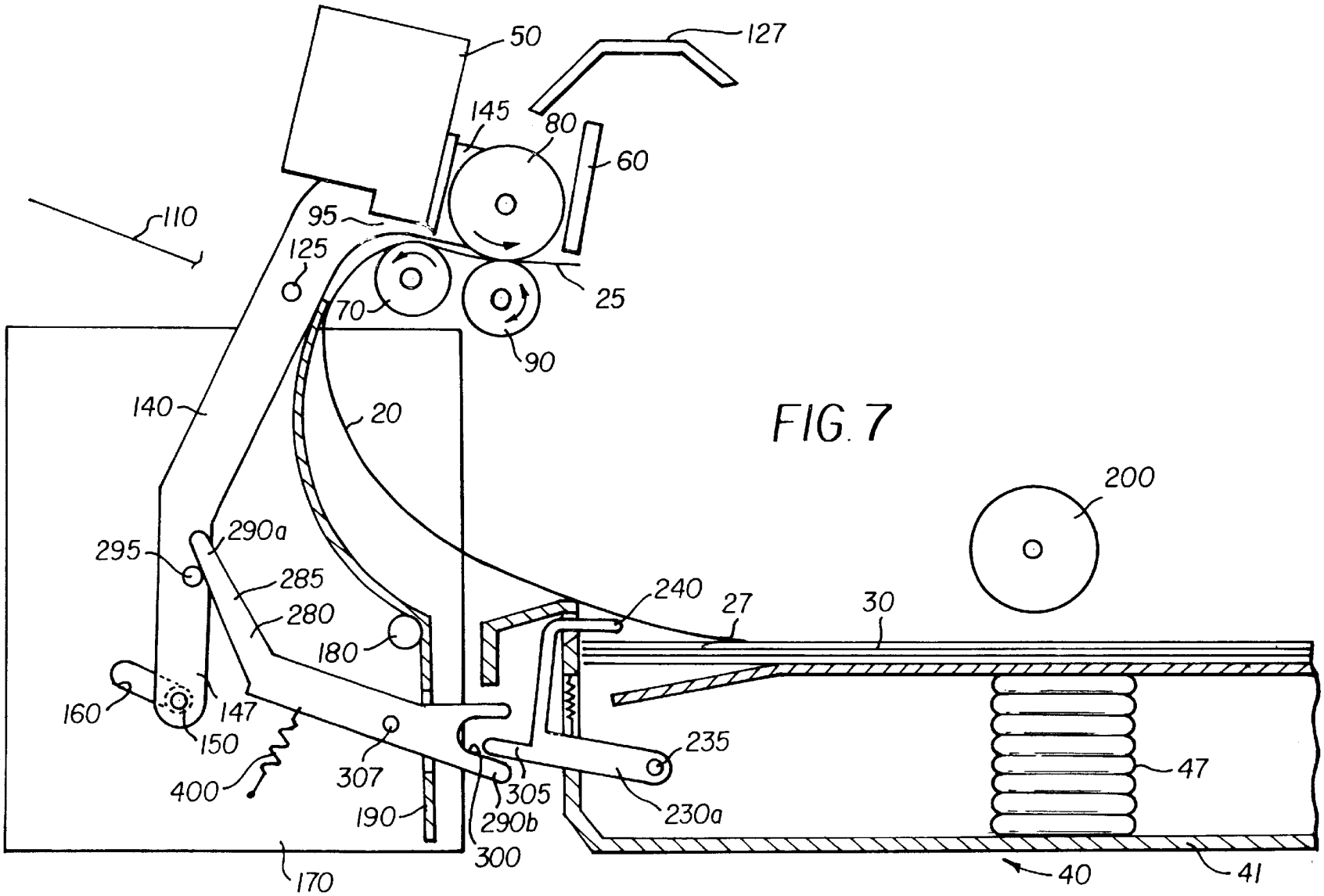
FIG. 7 is a view in elevation of a second embodiment of the present invention, with parts removed for clarity.

Referring to FIG. 7, there is shown a second embodiment of the present invention, wherein the actuator is a linking member or cantilever 280 comprising a movable beam 285 having a first end portion 290*a* in intimate sliding contact with arm 140 and a second end portion 290*b* having a recess 300 therein. First end portion 290*a* is in sliding contact with arm 140 such as by slidably contacting a post 295 outwardly projecting from arm 140. Thus, as arm 140 is caused to move, post 295 slides along first end portion 290 of beam 285. In this second embodiment of the present invention, lever 220 has an extended portion 305 to be received in recess 300. Beam 285 of cantilever 280 is preferably pivotably connected to frame 170 by a pivot pin 307. Moreover, a spring 400 may be provided for maintaining first end portion 290*a* in intimate sliding contact with arm 140 as beam 285 pivots. For this purpose, spring 400 has a first end portion attached to beam 285 and a second end portion preferably connected to frame 170. Thus, as arm 140 is caused to move, post 295 slides along first end portion 290 of beam 285 to pivot beam 285 in a clockwise direction about pivot pin 307. As beam 285 pivots in the clockwise direction, recess 300 engages extended portion 305 to pivot lever 220 in the counter-clockwise direction. As lever 200 pivots in the counter-clockwise direction, fingers 240 will uncover front edge 48 of stack of receiver sheets 30. Of course, previously mentioned spring 250 positively biases lever 220, so that lever 220 pivots about pivot pins 235 in the clockwise direction, as receiver sheet 20 returns to supply tray 40, in order to cover front edge 48 of stack of receiver sheets 30. Thus, it may be appreciated that actuation of lever 220 is achieved by movement of arm 140 which is connected to print head 50. That is, according to this second embodiment of the present invention, affirmative movement of lever 220 in the counter-clockwise direction is achieved by movement of print head 50 during the printing process.

Figure 8:
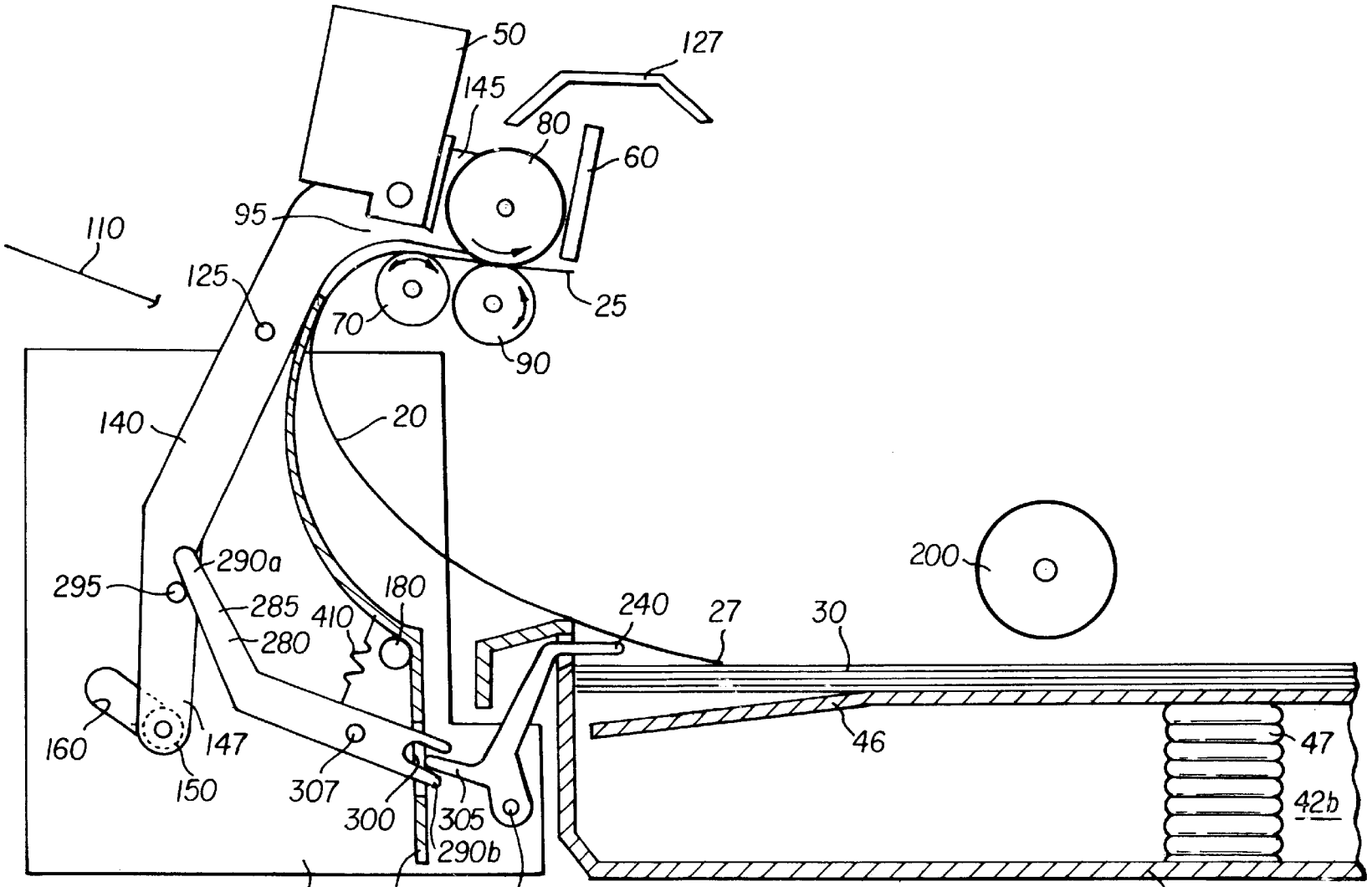
FIG. 8 is a view in elevation of a third embodiment of the present invention, with parts removed for clarity.

Referring to FIG. 8, there is shown a third embodiment of the present invention. According to this third embodiment of the present invention, a spring 410 has one end thereof attached to beam 285 and another end thereof attached to guide chute 190 for biasing beam 285 in a counter-clockwise direction so that recess 300 engages extended portion 305 of lever 220 in order to rotate lever 220 in the clockwise direction. Thus, spring 400 is absent in this third embodiment of the present invention. Also, when lever 220 rotates in the clockwise direction, fingers 240 will cover front edge 48 of stack of receiver sheets 30. When arm 140 rotates in the clockwise direction, bolt 250 will slide along first end portion 290*a* to rotate beam 285 in the counter-clockwise direction. As beam 285 rotates in the counter-clockwise direction, recess 300 is brought into engagement with extended portion 305 of lever 220. As recess 300 engages extended portion 305 of lever 220, the lever 220 pivots in a clockwise direction so that fingers 240 cover front edge 48 of stack of receiver sheets 30. In this third embodiment of the invention, lever 220 pivots about a pivot pin 420, which may be attached to frame 170, if desired. Thus, it may be understood that spring 250 is absent because it is not required in this third embodiment of the present invention. Thus, it may be appreciated that actuation of lever 220 is achieved by movement of arm 140 which is connected to print head 50. That is, according to this third embodiment of the present invention, affirmative movement of lever 220 in the counter-clockwise direction is achieved by movement of print head 50 during the printing process.

Figure 9:
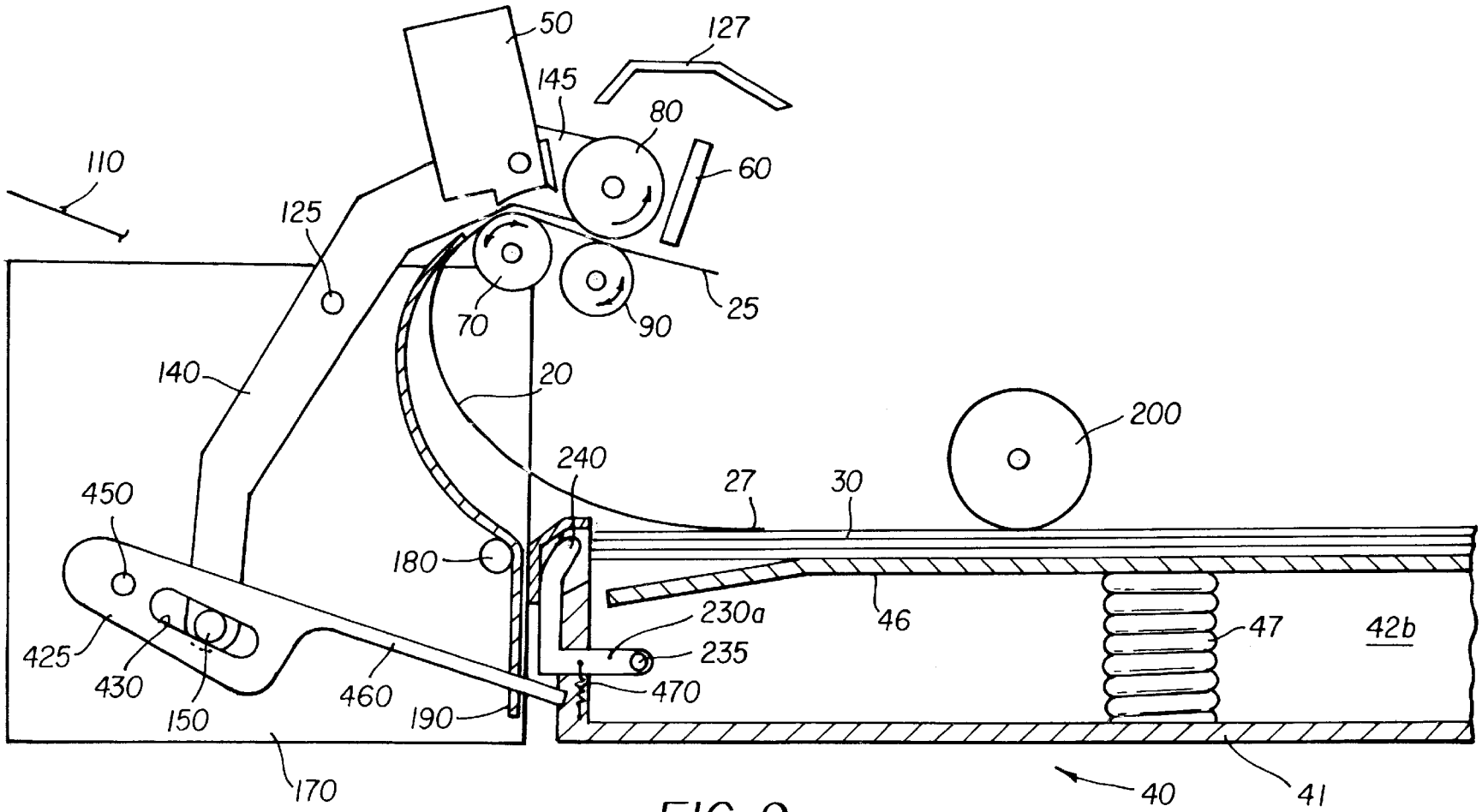
FIG. 9 is a view in elevation of a fourth embodiment of the present invention, with parts removed for clarity.
Figure 10:
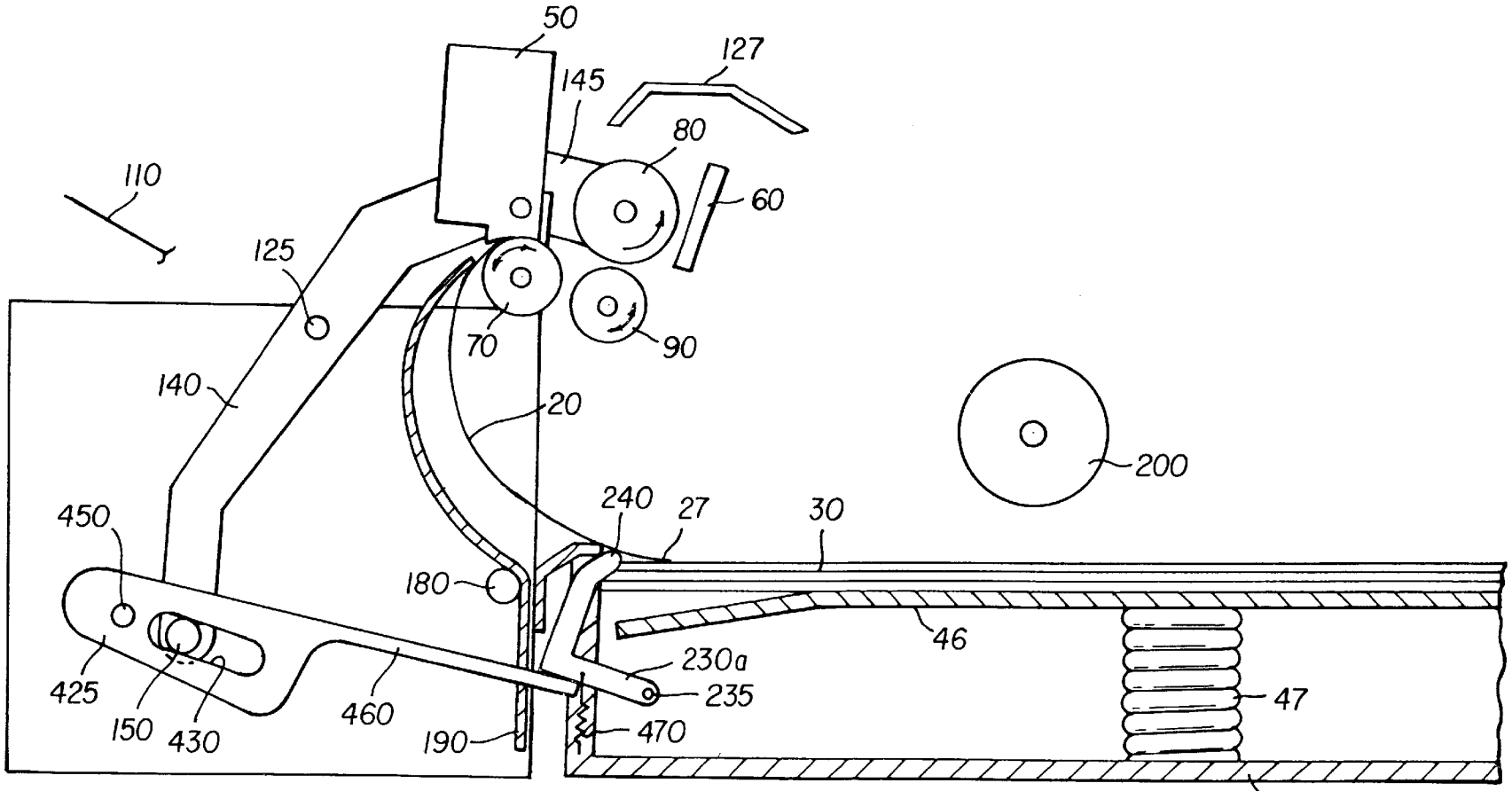
FIG. 10 is a view in elevation of a fifth embodiment of the present invention, with parts removed for clarity.

Referring to FIGS. 9 and 10, there is shown a fourth embodiment of the present invention. According to this fourth embodiment of the present invention, a reconfigured cantilever 425 has a slot 430 therein sized to receive wheel 150 belonging to arm 140. Moreover, reconfigured cantilever 425 has a first end portion thereof pivotably connected to frame 170, such as by means of a pivot pin 450. A second end portion of reconfigured cantilever 425 has an extended paddle portion 460 for engaging lever 220. It may be appreciated that as arm 140 moves in a clockwise direction, wheel 150 will slide in slot 430 toward pivot pin 450, so that reconfigured cantilever 425 pivots in a counter-clockwise direction about pivot pin 450. As reconfigured cantilever 425 pivots in the counter-clockwise direction about pivot pin 450 while receiver sheet 20 returns to supply tray 40, paddle portion 460 will engage lever 220 to pivot lever 220 in a clockwise direction so that fingers 240 extend through apertures 43 and cover front edge portion 48 of stack of sheets 30. Conversely, as arm 140 moves in a counter-clockwise direction, wheel 150 will slide in slot 430 away from pivot pin 450, so that reconfigured cantilever 425 pivots in a clockwise direction about pivot pin 450. As reconfigured cantilever 425 pivots in a clockwise direction about pivot pin 450 while receiver sheet 20 is fed from supply tray 40, paddle portion 460 will tend to disengage lever 220 so that a spring 470 interconnecting lever 220 and sidewall 42*a* pivots lever 220 in a counter-clockwise direction. In this manner, fingers 240 are caused to retract through apertures 43 and uncover front edge portion 48 of stack of sheets 30. Thus, it may be appreciated that actuation of lever 220 is achieved by movement of arm 140 which is connected to print head 50. That is, according to this fourth embodiment of the present invention, affirmative movement of lever 220 in the clockwise direction is achieved by movement of print head 50 during the printing process.

Figure 11:
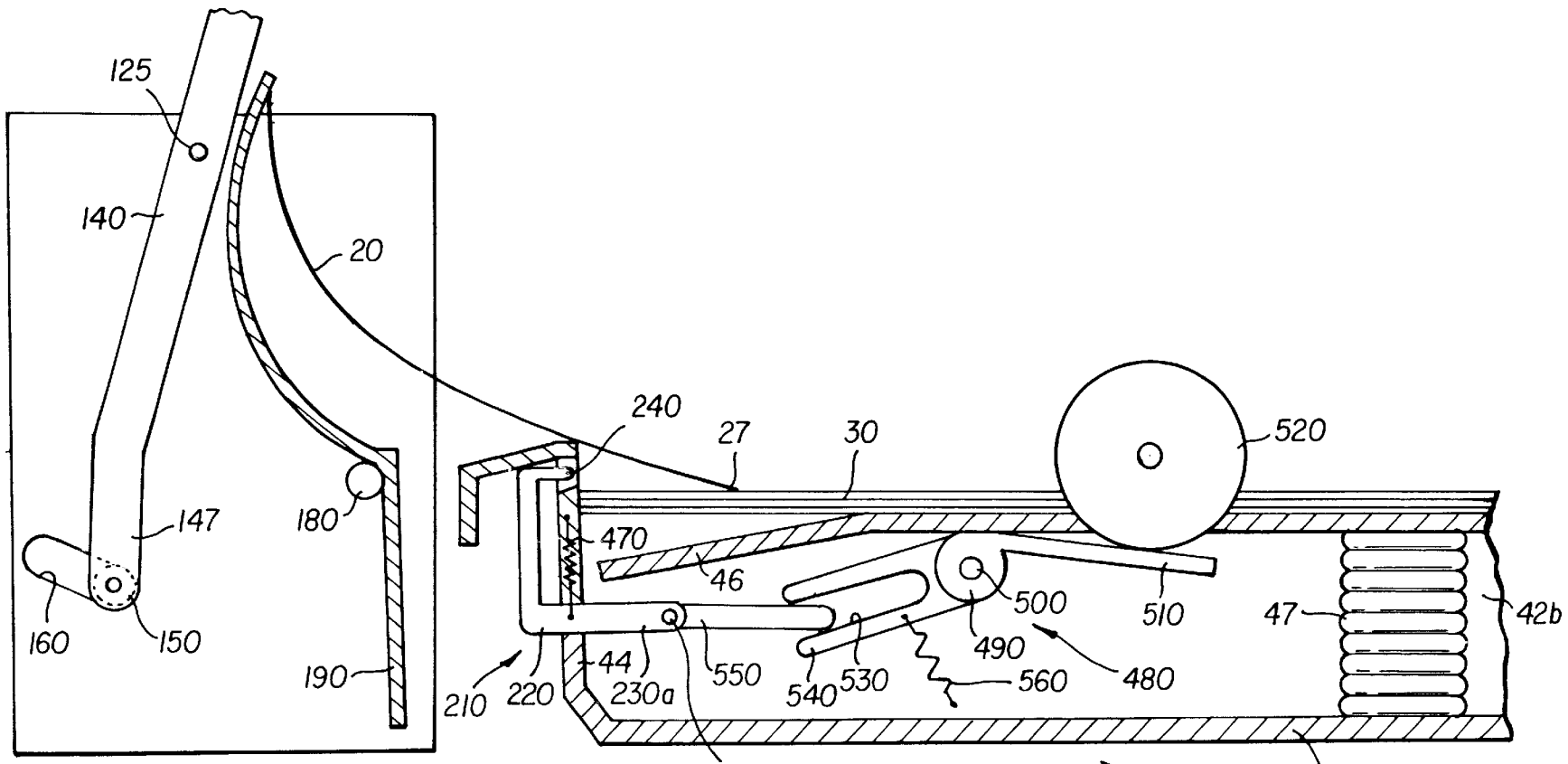
FIG. 11 is a view in elevation of a sixth embodiment of the present invention, with parts removed for clarity, this view showing the lever uncovering the front edge portion of the stack of receiver sheets, the lever being actuated by a bracket assembly.
Figure 12:
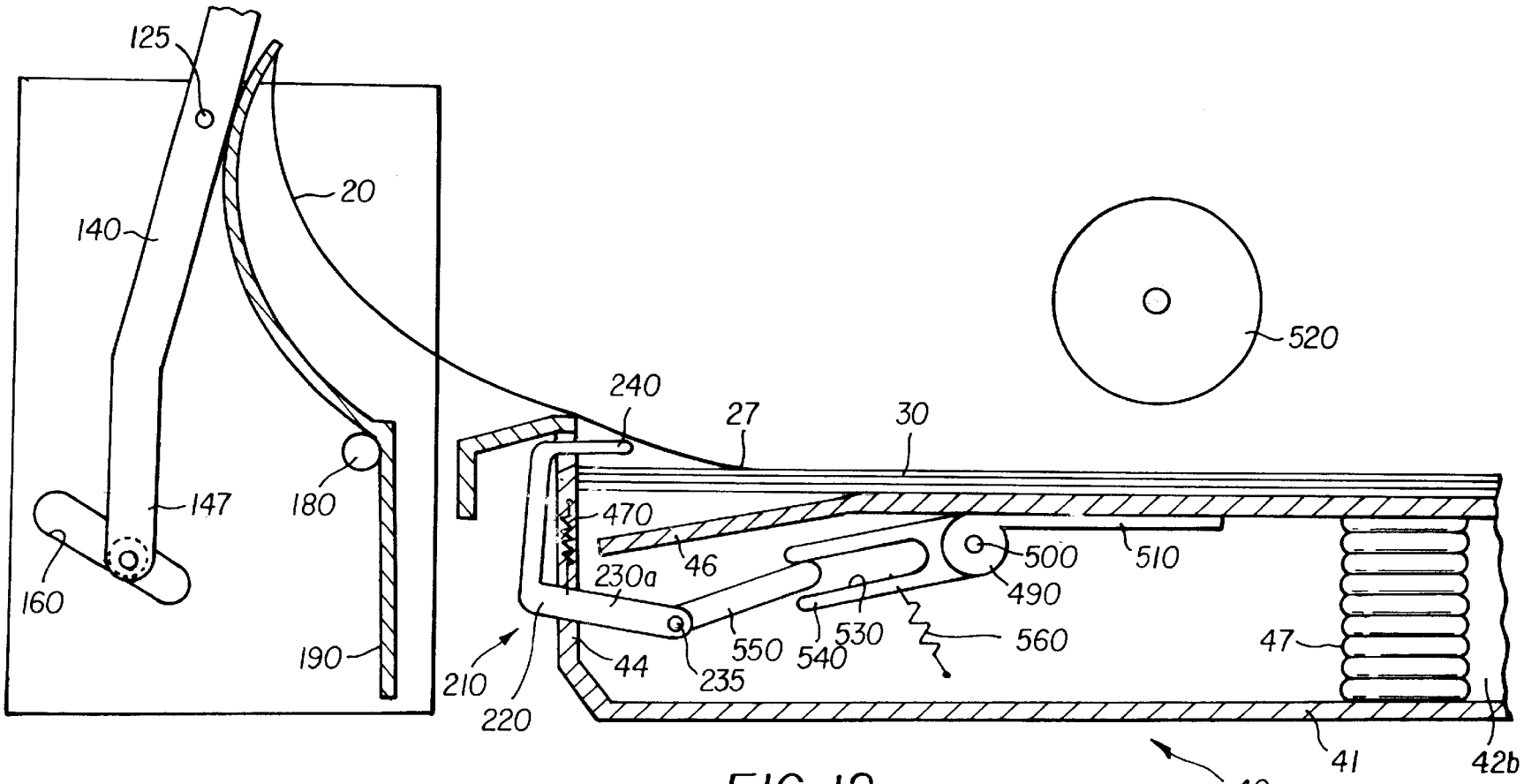
FIG. 12 is a view in elevation of the sixth embodiment of the present invention, with parts removed for clarity, this view showing the lever covering the front edge portion of the stack of receiver sheets, the lever being actuated by the bracket assembly.
Figure 13:
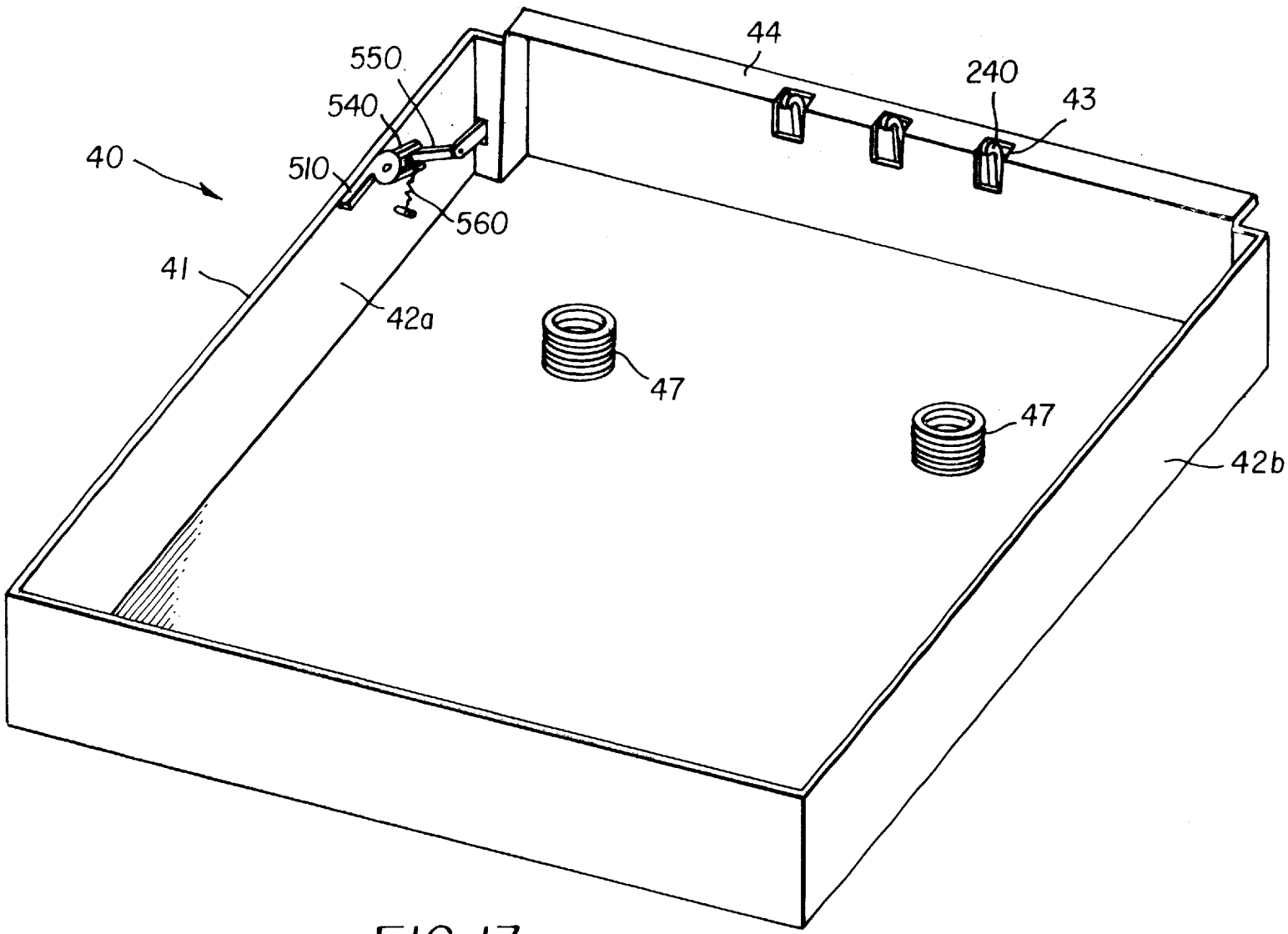
FIG. 13 is a view in elevation of the sixth embodiment of the present invention, wherein the bracket assembly is connected to a sidewall of the supply tray.

Referring to FIGS. 11, 12 and 13, there is shown a fifth embodiment of the present invention. According to this fifth embodiment of the present invention, the actuator comprises a bracket assembly, generally referred to as 480, for actuating lever 220. Bracket assembly 480 comprises a bracket 490 pivotable about a pivot pin 500 attached to first sidewall 42*a*. Bracket 490 includes a ledge 510 at a first end portion thereof for engaging a depression member, such as a depression roller 520. Depression roller 520 is connected to picker roller 200 and co-axially aligned therewith, such as by means of an axle (not shown), but preferably has a larger diameter than picker roller 200. Thus, as picker roller 200 moves downwardly to engage receiver sheet 20 in order to feed receiver sheet 20 from supply tray 40, depression roller 520 due to its larger diameter will depress ledge 510 so that bracket 490 pivots in a counter-clockwise direction about pivot pin 500. Bracket 490 also includes a cut-out 530 formed in a second end portion 540 thereof for receiving a leg portion 550 connected to first flange portion 230*a*. Thus, it may be understood that, as bracket 490 pivots in a counter-clockwise direction about pivot pin 500, cut-out 540 will engage leg portion 550 to pivot lever 220 in a clockwise direction, so that fingers 240 uncover front edge 48 of stack of sheets 30. Moreover, a spring 560 is also provided. Spring 560 has a first end thereof attached to second end portion 540 of bracket 490 for moving bracket 490 in a counter-clockwise direction about pivot pin 500 so that cut-out 530 engages leg portion 550 as picker roller 200 and associated depression roller 520 simultaneously upwardly move. In this manner, fingers 240 will cover front edge portion 48 of stack of sheets 30. Thus, it may be appreciated that actuation of lever 220 is achieved by movement of picker roller 200. That is, according to this fifth embodiment of the present invention, affirmative movement of lever 220 in the clockwise direction is achieved by movement of picker roller 200 during the printing process.

Figure 14:
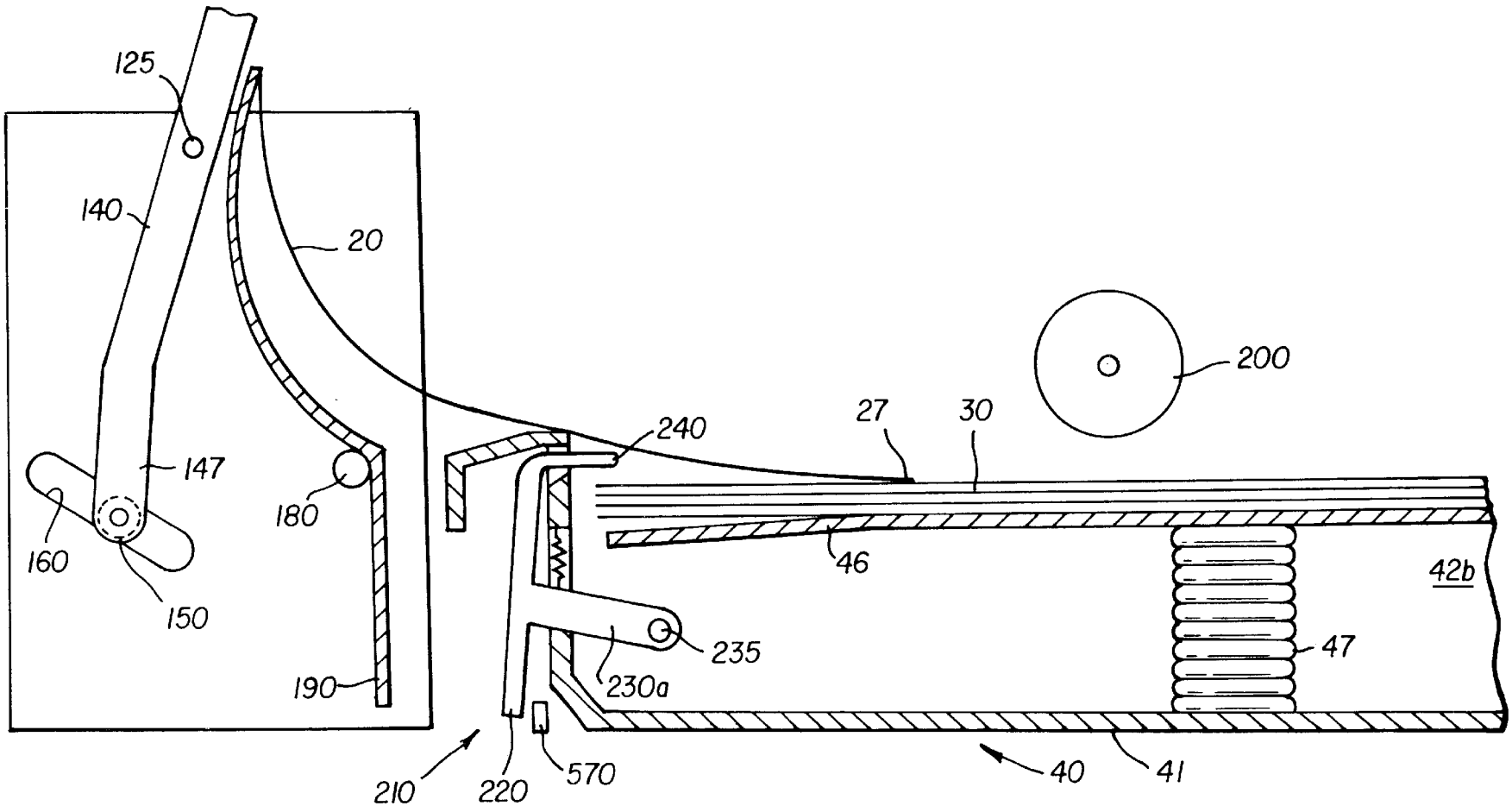
FIG. 14 is a view in elevation of a seventh embodiment of the present invention.

Referring to FIG. 14, there is shown a sixth embodiment of the present invention. According to this sixth embodiment of the present invention, the actuator comprises an electromagnet 570 disposed adjacent to lever 220. In this regard, electromagnet 570 is in electromagnetic communication with lever 220 for moving lever 220 to the second position thereof uncovering front edge portion 48 of stack of sheets 30. Previously mentioned spring 250 is present to move lever 220 to the second position thereof covering the front edge portion of stack of sheets 30. Activation of electromagnet 570 may be keyed to movement of arm 140, picker roller 200 or operation of optical sensor 60 by means of suitable electronic circuitry (not shown).

Returning to FIG. 1, it may be understood that the actuator may comprise previously mentioned optical sensor 60 for activating a suitable motor (not shown) connected to lever 220. In this regard, sensor 60 activates lever 220 according to signals generated by sensor 60 and transmitted to the motor when sensor 60 detects presence and absence of leading edge 25 of receiver sheet 20.

It may be appreciated that an advantage of the present invention is that use thereof reduces printer down-time, receiver wastage and thereby reduces cost of printer operation. This is so because the invention prevents receiver feed path obstruction due to the trailing edge of the returning receiver sheet abutting the stack of receiver sheets in the supply tray. In this manner, the receiver sheet being returned to the supply tray does not jam, foul, and otherwise obstruct the receiver sheet feed path.

The invention has been described in detail with particular reference to certain preferred embodiments thereof, but it will be understood that variations and modifications can be effected within the spirit and scope of the invention. For example, the platen may move upwardly and downwardly rather than the print head being moved upwardly and downwardly during the printing process. In this case, the actuator may be keyed to movement of the platen rather than movement of the print head.

Therefore, what is provided is a printer having an interference-free receiver sheet feed path and method of assembling the printer.

PARTS LIST

10 . . . printer
20 . . . receiver sheet
25 . . . leading edge (of receiver sheet)
27 . . . trailing edge (of receiver sheet)
30 . . . stack of receiver sheets
40 . . . receiver sheet supply tray
41 . . . tray body
42*a*/*b* . . . sidewalls
43 . . . apertures
44 . . . front wall portion (of tray body)

46 . . . support
47 . . . spring
48 . . . front edge portion (of stack of receiver sheets)
50 . . . print head
60 . . . optical sensor
70 . . . platen
80 . . . pinch roller
90 . . . capstan roller
95 . . . nip
100 . . . dye donor supply spool
110 . . . dye donor ribbon
120 . . . dye donor take-up spool
125 . . . tensioning pin
127 . . . tensioning bracket
130 . . . output bin
140 . . . ann
145 . . . first end portion (of arm)
147 . . . second end portion (of arm)
150 . . . wheel
160 . . . slot
170 . . . frame
180 . . . support bolt
190 . . . guide chute
200 . . . picker roller
210 . . . canopy
220 . . . lever
225 . . . bar
230*a*/*b* . . . flange portion
235 . . . pivot pins
240 . . . fingers
245 . . . end portion (of fingers)
250 . . . spring
260 . . . solenoid mechanism
270 . . . piston rod
280 . . . cantilever/linking member
285 . . . beam
290*a*/*b* . . . end portions (of cantilever)
295 . . . post
300 . . . recess
305 . . . extended portion (of lever)
400 . . . spring
410 . . . spring
420 . . . pivot pin
425 . . . reconfigured cantilever
430 . . . slot
450 . . . pivot pin
460 . . . paddle portion
470 . . . spring
480 . . . bracket assembly
490 . . . bracket
500 . . . pivot pin
510 . . . ledge
520 . . . depression roller
530 . . . cut-out
540 . . . second end portion (of bracket)
550 . . . leg portion
560 . . . spring
570 . . . electromagnet

What is claimed is:

1. A printer having an interference-free receiver sheet feed path, comprising:

(a) a print head for printing an image on a receiver sheet having a trailing edge, the receiver sheet belonging to a stack of receiver sheets having a front edge portion;

(b) a roller mechanism coupled to said print head and adapted to engage the receiver sheet for advancing the receiver sheet from the stack of receiver sheets along a receiver sheet feed path extending from the stack of receiver sheets to said print head and for returning the receiver sheet to the stack of receiver sheets along the receiver sheet feed path;

(c) a receiver sheet supply tray associated with said roller mechanism for holding the stack of receiver sheets, so that the receiver sheet is advanced therefrom;

(d) a lever coupled to said tray, said lever having a cover portion adapted to cover the front edge portion of the stack, of receiver sheets, so that the trailing edge of the receiver sheet avoids contact with the front edge portion of the stack of receiver sheets while the receiver sheet returns to the stack of receiver sheets, and so that the receiver sheet feed path is interference-free while the trailing edge of the receiver sheet avoids contact with the front edge portion of the stack of receiver sheets;

(e) a spring coupled to said lever for biasing said lever, so that the cover portion of said lever covers the front edge portion of the stack of receiver sheets to prevent the front edge portion from interfering with movement of the receiver sheet; and (f) an actuator engaging said lever for actuating said lever, so that the cover portion of said lever uncovers the front edge portion of the stack of receiver sheets while said lever is actuated; and wherein said actuator comprises a cantilever coupled to said print head, said cantilever being adapted to move said lever so that the cover portion of said lever uncovers the front edge portion of the stack of sheets only while the receiver sheet advances from the stack of receiver sheets.

2. The printer of claim 1, wherein said cantilever comprises:

(a) a movable arm coupled to said print head, said arm having a post integrally formed thereon;

(b) a movable beam having an anterior portion thereof abutting the post and a posterior portion thereof having a recess therein for engaging said lever, whereby the post engages the anterior portion of said beam while said arm moves, whereby said beam moves while the post engages the anterior portion of said beam, whereby the recess engages said lever to move said lever while said beam moves, and whereby the cover portion of said lever covers the front edge portion of the stack of receiver sheets while said lever moves.

3. The printer of claim 1, wherein said cantilever comprises:

(a) an arm coupled to said print head, said arm having a post integrally formed thereon; and (b) a movable beam having a slot therein for slidably engaging the post and having a protruding portion thereof for engaging said lever, whereby the post slidably engages the slot of said beam while said arm moves, whereby said beam moves while the post engages the slot in said beam, whereby the protruding portion of said beam engages said lever for moving said lever while said beam moves, and whereby the cover portion of said lever covers the front edge portion of the stack of receiver sheets while said lever moves.

4. A printer having an interference-free receiver sheet feed path comprising:

(a) a print head for printing an image on a receiver sheet having a trailing edge, the receiver sheet belonging to a stack of receiver sheets having a front edge portion;

(b) a roller mechanism coupled to said print head and adapted to engage the receiver sheet for advancing the receiver sheet from the stack of receiver sheets along a receiver sheet feed path extending from the stack of receiver sheets to said print head and for returning the receiver sheet to the stack of receiver sheets along the receiver sheet feed path;

(c) a receiver sheet supply tray associated with said roller mechanism for holding the stack of receiver sheets; so that the receiver sheet is advanced therefrom;

(d) a lever coupled to said tray, said lever having a cover portion adapted to cover the front edge portion of the stack of receiver sheets, so that the trailing edge of the receiver sheet avoids contact with the front edge portion of the stack of receiver sheets while the receiver sheet returns to the stack of receiver sheets, and so that the receiver sheet feed path is interference-free while The tailing edge of the receiver sheet avoids contact with the front edge portion of the stack of receiver sheets;

(e) a spring coupled to said lever for biasing said lever, so that the cover portion of said lever covers the front edge portion of the stack of receiver sheets to prevent the front edge portion from interfering with movement of the receiver sheet; and (f) an actuator engaging said lever for actuating said lever, so that the cover portion of said lever uncovers the front edge portion of the stack of receiver sheets while said lever is actuated; and wherein said actuator comprises a bracket assembly having a first end portion thereof engageable with said roller mechanism and a second end portion having a cutout engageable with said lever, said bracket being pivotable about a pivot point intermediate the first end portion and the second end portion, whereby said bracket pivots about the pivot point while said roller mechanism engages the first end portion of said bracket, whereby the cutout edges said lever while said bracket pivots, and whereby said lever uncovers the front edge portion of the stack of receiver sheets while the cut-out engages said lever.

5. A printer having an interference-free receiver sheet feed path, comprising:

(a) a print head for printing an image on a receiver sheet having a trailing edge, the receiver sheet belonging to a stack of receiver sheets having a front edge portion;

(b) a roller mechanism coupled to said print head and adapted to engage the receiver sheet for advancing the receiver sheet from the stack of receiver sheets along a receiver sheet feed path extending from the stack of receiver sheets to said print head and for returning the receiver sheet to the stack of receiver sheets along the receiver sheet feed path;

(c) a receiver sheet supply tray associated with said roller mechanism for holding the stack of receiver sheets so that the receiver sheet is advanced therefrom;

(d) a lever coupled to said tray, said lever having a cover potion adapted to cover the front edge portion of the stack of receiver sheets, so that the trailing edge of the receiver sheet avoids contact with the front edge portion of the stack of receiver sheets while the receiver sheet returns to the stack of receiver sheet, and so that the receiver sheet feed path is interference-free while the trailing edge of the receiver sheet avoids contact with the front edge portion of the stack of receiver sheets;

(e) a spring coupled to said lever for biasing said lever, so that the cover portion of said lever covers the front edge portion of the stack of receiver sheets to prevent the front edge portion from interfering with movement of the receiver sheet; and (f) an actuator engaging said lever for actuating said lever, so the cover portion of said lever uncovers the front edge potion of the stack of receiver sheets while said lever is actuated; and wherein said actuator comprises a sensor coupled to said lever and capable of being disposed in sensing relation to the receiving sheet for sensing movement of the receiver sheet along the receiver sheet feed path, so that said sensor actuates said lever after the receiver sheet moves a predetermined distance.

6. A printer having an interference-free receiver sheet feed path, comprising:

(a) a print head for printing an image on a receiver sheet having a trailing edge, the receiver sheet belonging to a stack of receiver sheets having a front edge portion;

(b) a roller mechanism coupled to said print head and adapted to engage the receiver sheet for advancing the receiver sheet from the stack of receiver sheets along a receiver sheet feed path extending from the stack of receiver sheets to said print head and for returning the receiver sheet to the stack of receiver sheets along the receiver sheet feed path;

(c) a receiver sheet supply tray associated with said roller mechanism for holding the stack of receiver sheets, so that the receiver sheet is advanced therefrom;

(d) a lever coupled to said tray, said lever having a cover portion adapted to cover the front edge portion of the stacks of receiver sheets, so that the trailing of the receiver sheet avoids contact with the front edge portion of the stack of receiver sheets while the receiver sheet returns to the stack of receiver sheets, and so that the receiver sheet feed path is interference-free while the trailing edge of the receiver sheet avoids contact with the front edge portion of the stack of receiver sheets;

(e) a spring coupled to said lever for biasing said lever, so that the cover portion of said lever covers the front edge portion of the stack of receiver sheets to prevent the front edge portion from interfering with movement of the receiver sheet; and (f) an actuator engaging said lever for actuating said lever, so that the cover portion of said lever uncovers the front edge portion of the stack of receiver sheets while said lever is actuated; and wherein said actuator comprises an electromagnet in electromagnetic communication with said lever for moving said lever from a first position thereof uncovering the front edge portion of the stack of receiver sheets to a second position thereof covering the front edge portion of the stack of receiver sheets.

7. A method of assembling a printer having an interference-free receiver sheet feed path, comprising the steps of:

(a) providing a print head for printing an image on a receiver sheet having a trailing edge, the receiver sheet belonging to a stack of receiver sheets having a front edge portion;

(b) coupling a roller mechanism to the print head, the feed roller mechanism being adapted to engage the receiver sheet for advancing the receiver sheet from the stack of receiver sheets along a receiver sheet feed path extending from the stack of receiver sheets to the print head and for returning the receiver sheet to the stack of receiver sheets along the receiver sheet feed path;

(c) providing a receiver sheet supply tray associated with the roller mechanism for holding the stack of receiver sheets; so that the receiver sheet is advanced therefrom;

(d) coupling a lever to the tray, the lever having a cover portion adapted to cover the front edge portion of the stack of receiver sheets, so that the trailing edge of the receiver sheet avoids contact with the front edge portion of the stack of receiver sheets while the receiver sheet returns to the stack of receiver sheets, and so that the receiver sheet feed path is interference-free while the trail edge of the receiver sheet avoids contact with the front edge portion of the stack of receiver sheets;

(e) coupling a spring to the lever for biasing the lever, so that the cover portion of the lever covers the front edge portion of the stack of receiver sheets to prevent the front edge portion from interfering with movement of the receiver sheet; and (f) engaging an actuator with the lever for actuating the lever, so that the cover portion of the lever uncovers the front edge portion of the stack of receiver sheets while the lever is actuated; and wherein the step of engaging an actuator with, the lever comprises the step of coupling a cantilever to the print head, the cantilever being adapted to move the lever so that the cover portion of the lever uncovers the front edge portion of the stack of sheets only while the receiver sheet advances from the stack of receiver sheets.

8. The method of claim 7, wherein the step of coupling a cantilever comprises the steps of:

(a) coupling a movable arm to the print head, the arm having a post integrally formed thereon;

(b) providing a movable beam having an anterior portion thereof abutting the post and a posterior portion thereof having a recess therein for engaging the lever, whereby the post engages the anterior portion of the beam while the arm moves, whereby the beam moves while the post engages the anterior portion of the beam, whereby the recess engages the lever to move the lever while the beam moves, and whereby the cover portion of the lever covers the front edge portion of the stack of receiver sheets while the lever moves.

9. The method of claim 7, wherein the step of coupling a cantilever comprises the steps of:

(a) coupling an arm to the print head, the arm having a post integrally formed thereon; and (b) providing a movable beam having a slot therein for slidably engaging the post and having a protruding portion thereof for engaging the lever, whereby the post slidably engages the slot of the beam while the arm moves, whereby the beam moves while the post engages the slot in the beam, whereby the protruding portion of the beam engages the lever for moving the lever while the beam moves, and whereby the cover portion of the lever covers the front edge portion of the stack of receiver sheets while the lever moves.

10. A method of assembling a printer having an interference-free receiver sheet feed path, comprising the steps of:

(a) providing a print head for printing an image on a receiver sheet having a trailing edge, the receiver sheet belonging to a stack of receiver sheets having a front edge portion;

(b) coupling a roller mechanism to the print head, the feed roller mechanism being adapted to engage the receiver sheet for advancing the receiver sheet from the stack of receiver sheets along a receiver sheet feed path extending from the stack of receiver sheets to the print head and for returning the receiver sheet to the stack of receiver sheets along the receiver sheet feed path;

(c) providing a receiver sheet supply tray associated with the roller mechanism for holding the stack of receiver sheets, so that the receiver sheet is advanced therefrom;

(d) coupling a lever to the tray, the lever having a cover portion adapted to cover the front edge portion of the stack of receiver sheets, so that the trailing edge of the receiver sheet avoids contact with the front edge portion of the stack of receiver sheets while the receiver sheet returns to the stack of receiver sheets, and so that the receiver sheet feed path is interference-free while the trailing edge of the receiver sheet avoids contact with the movement edge portion of the stack of receiver sheets;

(e) coupling a spring to the lever for biasing the lever, so that the cover portion of the lever covers the front edge portion of the stack of receiver sheets to prevent the front edge portion from interfering with movement of the receiver sheet; and (f) engaging an actuator with the lever for actuating the lever, so that the cover portion of the lever uncovers the front edge portion of the stack of receiver sheets while the lever is actuated; and wherein the step of engaging an actuator with the lever comprises the step of providing a bracket assembly having a first end portion thereof engageable with the roller mechanism and a second end portion having a cut-out engageable with the lever, the bracket being pivotable about a pivot point intermediate the first end portion and the second end portion, whereby the bracket pivots about the pivot point while the roller mechanism engages the first end portion of the bracket, whereby the cut-out engages the lever while the bracket pivots, and whereby the lever uncovers the front edge portion of the stack of receiver sheets while the cut-out engages the lever.

11. A method of assembling a printer having an interference-free receiver sheet feed pad, comprising the steps of:

(a) providing a print head for printing an image on a receiver sheet having a trailing edge, the receiver sheet belonging to a stack of receiver sheets having a front edge portion;

(b) coupling a roller mechanism to the print head, the feed roller mechanism being adapted to engage the receiver sheet for advancing the receiver sheet from the stack of receiver sheets along a receiver sheet feed path extending from the stack of receiver sheets to the print head and for returning the receiver sheet to the stack of receiver sheets along the receiver sheet feed path;

(c) providing a receiver sheet supply tray associated with the roller mechanism for holding the stack of receiver sheets, so that the receiver sheet is advanced therefrom;

(d) coupling a lever to the tray, the lever having a cover portion adapted to cover the front edge portion of the stack of receiver sheets, so that the trailing edge of the receiver sheet avoids contact with the front edge portion of the stack of receiver sheets while the receiver sheet returns to the stack of receiver sheets, and so that the receiver sheet feed path is interference-free while the trailing edge of the receiver sheet avoids contact with the front edge portion of the stack of receiver sheets;

(e) coupling a spring to the lever for biasing the lever, so that the cover portion of the lever covers the front edge portion of the stack of receiver sheets to prevent the front edge portion from interfering with movement of the receiver sheet; and (f) engaging an actuator with the lever for actuating the lever, so that the cover portion of the lever uncovers the front edge portion of the stack of receiver sheets while the lever is actuated; and wherein the step of engaging an actuator with the lever comprises the step of providing a sensor coupled to the lever and capable of being disposed in sensing relation to the receiver sheet for sensing movement of the receiver sheet along the receiver sheet feed path, so that the sensor actuates the lever after the receiver sheet moves a predetermined distance.

* * * * *